US011656021B2

(12) United States Patent
Shibuya et al.

(10) Patent No.: US 11,656,021 B2
(45) Date of Patent: May 23, 2023

(54) REFRIGERATOR

(71) Applicant: Samsung Electronics Co., Ltd., Suwon-si (KR)

(72) Inventors: Makoto Shibuya, Yokohama (JP); Kentaro Kan, Yokohama (JP); Manabu Kikuchi, Yokohama (JP); Tomohiko Matsuno, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/469,319

(22) Filed: Sep. 8, 2021

(65) Prior Publication Data

US 2022/0090844 A1 Mar. 24, 2022

(30) Foreign Application Priority Data

Sep. 18, 2020 (JP) ..... JP2020-156952
Jun. 8, 2021 (KR) ..... 10-2021-0074201

(51) Int. Cl.
*F25D 19/04* (2006.01)
*E04B 1/61* (2006.01)
(Continued)

(52) U.S. Cl.
CPC ..... *F25D 19/04* (2013.01); *E04B 1/6183* (2013.01); *F25D 17/08* (2013.01); *F25D 23/062* (2013.01); *F25D 2400/16* (2013.01)

(58) Field of Classification Search
CPC ..... F25D 19/04; F25D 17/08; F25D 2400/16; F25D 2317/067; F25D 23/028; F25D 23/025; F25D 2323/024; F25D 23/062; F25D 23/006; E05B 65/0817; E05B 65/006; E05B 9/00; E05B 63/123; E05B 2047/0017; E05B 9/08
See application file for complete search history.

(56) References Cited

U.S. PATENT DOCUMENTS 3,432,196 A * 3/1969 Giovanni ..... E04B 1/617 52/584.1
3,472,545 A * 10/1969 Berkowitz ..... E04B 1/6183 292/111
(Continued)

FOREIGN PATENT DOCUMENTS

JP 52-26382 U 6/1977
JP 2002-090034 A 3/2002
(Continued)

OTHER PUBLICATIONS

English translation for JP2002090034 (Year: 2002).*
International Search Report dated Jan. 6, 2022, issued in International Patent Application No. PCT/KR2021/012217.

*Primary Examiner* — Hiwot E Tefera
(74) *Attorney, Agent, or Firm* — Jefferson IP Law, LLP

(57) ABSTRACT

A refrigerator having detachably adjacent cabinets is provided. The refrigerator includes a connection mechanism interposed between cabinets adjacent to each other and connecting the cabinets to each other and a manipulation portion configured to drive the connection mechanism by being manipulated from outside, wherein the connection mechanism is configured for the cabinet on one side is pulled toward the cabinet on the other side by a manipulation of the manipulation portion.

18 Claims, 7 Drawing Sheets

(51) Int. Cl.
*F25D 23/06* (2006.01)
*F25D 17/08* (2006.01)

(56) References Cited

U.S. PATENT DOCUMENTS 4,408,923 A * 10/1983 Kubler ..... F16B 12/2063 403/231
4,417,430 A * 11/1983 Loikitz ..... F25D 23/065 52/582.2
4,507,010 A * 3/1985 Fujiya ..... E04B 1/6183 403/323
4,512,122 A * 4/1985 Berkowitz ..... E04B 1/6183 292/DIG. 53
5,452,925 A * 9/1995 Huang ..... E05B 65/0817 292/65
5,921,095 A * 7/1999 Lee ..... F25D 29/005 62/DIG. 13
6,626,017 B2 * 9/2003 Herbeck ..... F24F 13/20 312/265.5
6,695,421 B1 2/2004 Frase et al.
8,162,415 B2 * 4/2012 Hagele ..... F25D 23/062 312/111
2003/0136887 A1 * 7/2003 Gabriel ..... D06F 39/125 248/188.2
2011/0006655 A1 1/2011 Seo et al.
2014/0290141 A1 * 10/2014 Mayer ..... E05B 63/123 292/96
2015/0211267 A1 * 7/2015 Finkelstein ..... E05C 3/14 29/446
2019/0310008 A1 * 10/2019 Marzi ..... F25D 17/065
2020/0056828 A1 2/2020 Kim et al.
2021/0293015 A1 * 9/2021 Gottschling ..... E04B 1/6183

FOREIGN PATENT DOCUMENTS

JP 2008-082634 A 4/2008
KR 19990030012 U * 7/1999
KR 10-2005-0064346 A 6/2005
KR 10-2016-0021187 A 2/2016
KR 10-1955119 B1 3/2019

* cited by examiner

REFRIGERATOR

CROSS-REFERENCE TO RELATED APPLICATION(S)

This application is based on and claims priority under 35 U.S.C. § 119(a) of a Japanese patent application number 2020-156952, filed on Sep. 18, 2020, in the Japan Patent Office, and of a Korean patent application number 10-2021-0074201, filed on Jun. 8, 2021, in the Korean Intellectual Property Office, the disclosure of each of which is incorporated by reference herein in its entirety.

BACKGROUND

1. Field

The disclosure relates to a refrigerator.

2. Description of Related Art

Among the refrigerators according to the related art, some refrigerators are configured to have a plurality of cabinets detachably provided such that the user freely customizes the layout of the cabinets or the internal volume of the body according to changes in lifestyle, such as childbirth, living on his/her own, and living with parents.

For example, as disclosed in Japanese Patent Laid Open Publication No. S 52-26382, there is a refrigerator in which two adjacent cabinets are connected to each other from the outside with a plate. However, such a configuration has a poor appearance due to the plate.

On the other hand, as disclosed in U.S. Pat. No. 8,162,415, there is a refrigerator in which two cabinets are connected by installing a ring-shaped fastening mechanism on opposing surfaces adjacent to each other of the cabinets, and inserting a pin in a state in which the cabinets communicate with each other.

With such a configuration, the appearance of the structure is not poor compared with the refrigerator disclosed in Japanese Patent Laid Open Publication No. S 52-26382, but when a seal is interposed between the two cabinets, the two cabinets need to be pushed with a force. Moreover, the pin needs to be inserted into the ring-shaped fastening mechanism between the cabinets while maintaining the state, for which a tool, such as a plier, may be required or the cooperation of others may be required, so there is a difficulty in connecting the two cabinets.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure to provide a refrigerator in which adjacent cabinets are detachably provided, that is capable of ensuring aesthetically pleasing appearance and allowing both side cabinets easily connected to each other.

Additional aspects will be set forth in part in the description which follows and, in part, will be apparent from the description, or may be learned by practice of the presented embodiments.

In accordance with an aspect of the disclosure, a refrigerator is provided. The refrigerator includes a first cabinet having a first cooling space, a second cabinet having a second cooling space independent of the first cooling space and detachably coupled to the first cabinet, a connection mechanism provided on a first opposing surface of the first cabinet opposite to the second cabinet to allow the second cabinet to be pulled toward the first cabinet and connected to the first cabinet, the connection mechanism provided to be rotatable on a rotation shaft, and a manipulation portion connected to the connection mechanism to drive the connection mechanism, and provided on the first cabinet to be manipulated from an outside of the first cabinet.

A second opposing surface of the second cabinet opposite to the first opposing surface may be provided with a caught portion, and the connection mechanism may include a catching portion that is formed to be engaged with the caught portion.

The catching portion may include an extension portion extending from the first cabinet to the second cabinet in a connected state in which the first cabinet and the second cabinet are connected to each other, and a front-end portion bent from a front-end of the extension portion toward the caught portion to be engaged with the caught portion.

The connection mechanism may be configured to rotate to between an accommodated state to be accommodated on an inner side of the first opposing surface of the first cabinet and a connected state to be engaged with the caught portion by allowing the second cabinet to be pulled toward the first cabinet and connected to the first cabinet.

The first opposing surface of the first cabinet may be formed with an accommodating portion, and when the connection mechanism is in the accommodated state, the connection mechanism may be accommodated in the accommodating portion without being protruded from the accommodating portion.

The caught portion may be formed on an inner side of the second opposing surface of the second cabinet without being protruded out of the second cabinet.

The second opposing surface of the second cabinet may be formed with a recessed portion, and when the connection mechanism is in the connected state, a part of the connection mechanism may be inserted into the recessed portion.

The manipulation portion may be provided with a tool hole to which a tool is connected, and the manipulation portion may be provided to be rotatable by the tool connected to the tool hole.

The manipulation portion may include at least a portion provided on a front-end surface of the first cabinet to be manipulated from the outside of the first cabinet.

The refrigerator may further include a door provided in front of the first cabinet to open and close the first cooling space, and a hinge member configured to rotatably couple the door to the first cabinet, wherein the at least a portion of the manipulation portion may be covered by the hinge member without being exposed to the outside.

The refrigerator may further include a power transmission mechanism provided between the manipulation portion and the connection mechanism to transmit an external force input to the manipulation portion to the connection mechanism.

The power transmission mechanism may include a worm connected to the manipulation portion and rotating together with the manipulation portion, and a worm wheel meshing with the worm and axially supported by the rotation shaft of the connection mechanism.

The refrigerator may further include a duct member provided between the first cabinet and the second cabinet to communicate the first cooling space with the second cooling space.

Each of the first cabinet and the second cabinet may include a communication hole that allows a corresponding one of the first cooling space and the second cooling space to communicate with the duct member, and the refrigerator may further include a seal member configured to seal the communication hole.

The refrigerator may further include a rear side connection mechanism provided to couple a rear end of the first cabinet to a rear end of the second cabinet, herein the rear side connection mechanism may include a connection plate arranged on a rear surface of the first cabinet and a rear surface of the second cabinet, and a fastening member configured to fasten the connection plate to the rear surface of the first cabinet and the rear surface of the second cabinet.

In accordance with another aspect of the disclosure, a refrigerator in which adjacent cabinets are detachably provided is provided. The refrigerator includes a connection mechanism interposed between the cabinets adjacent to each other and connecting the both side cabinets, and a manipulation portion for driving the connection mechanism by being manipulated from the outside, in which the connection mechanism is configured for one side cabinet is pulled to the other side cabinet by the manipulation portion being manipulated.

With such a configuration, since the connection mechanism is interposed between the adjacent cabinets, an aesthetically pleasing appearance of the refrigerator is secured. In addition, since the connection mechanism is configured to be driven by the manipulation of the manipulation portion such that one side cabinet is pulled and connected to the other side cabinet, so that the operator may simply connect the both side cabinets to each other without pliers or cooperation of others as described in the background art.

The cabinets on both sides each have opposing surfaces, and a caught portion may be provided on the opposing surface of one side. The connection mechanism may include a catching portion formed on the opposing surface of the other side and configured to be engaged the caught portion by a manipulation of the manipulation portion such that the one side cabinet is pulled and connected to the other side cabinet, in which in an unconnected state, the caught portion may be accommodated on the inner side of the opposing surface of the one side, and the locking portion may be accommodated on the inner side of the opposing surface of the other side.

With such a configuration, in the unconnected state in which the cabinets on both sides are aligned while being brought in close contact with each other, the caught portion is accommodated on the inner side of the opposing surface of one side, and the catching portion is accommodated on the inner side of the opposing surface of the other side, so that the opposing surfaces may be moved while following each other, which makes it easy to align the both side cabinets.

For example, in order to reliably connect the cabinets even when each portion of the cabinets on both sides is slightly shifted due to manufacturing error, etc., the catching portion includes an extension portion extends from the cabinet on the other side to the cabinet on the one side in a connected state in which the catching portion is connected, and a front-end portion formed to be bent from the extension portion toward the caught portion, in which the front-end portion is configured to be caught by the caught portion.

With such a configuration, because the front-end of the catching portion is bent, and the front-end portion is caught with the caught portion, even if the cabinets on both sides are slightly shifted, the front-end portion may be allowed to be caught with the catching portion.

As a specific embodiment of the catching portion and the caught portion, the catching portion is rotatable around a rotation axis provided on the opposing surface of the other side, and is rotatable between an accommodated state to be accommodated on an inner side of the opposing surface of the other side and a connected state to be engaged with the caught portion by rotating from the accommodated state toward the caught portion such that the cabinet of one side is pulled toward and connected to the cabinet of the other side.

The caught portion extends along a direction of a rotation axis of the catching portion.

With such a configuration, even when the cabinets on both sides are slightly shifted in the direction of the rotation axis of the catching portion, the front-end portion may be allowed to be caught by the caught portion.

The other side cabinet includes a cabinet body that opens in a forward direction, and an opening/closing door for closing the opening of the cabinet body, and the manipulation portion is provided on a front-end surface of the cabinet body facing the opening/closing door.

With such a configuration, when the opening/closing door is closed, the manipulation portion is not visible from the outside, so that aesthetically pleasing appearance of the refrigerator is secured. In addition, since the manipulation portion is hidden by, for example, a hinge member for an opening/closing door fixed to the front-end surface of the cabinet body, an aesthetically pleasing appearance of the refrigerator is secured.

In the refrigerator in which adjacent cabinets are detachably configured, when a cooling device is provided in each of the cabinets, the internal volume of the body is reduced and the manufacturing cost is greatly increased.

Therefore, as an embodiment for more remarkably exhibiting the effects of the disclosure while solving the above limitations, the refrigerator further includes a duct member interposed between the cabinets on both sides, the cabinets on both sides are each formed with communication holes for communicating cooling spaces formed inside thereof with the duct member, and the refrigerator further includes a seal member interposed between the cabinets and the duct member and sealing the communication holes.

With such a configuration, since the cooling spaces of the cabinets on both sides communicate with each other through the duct member, cold air may be transmitted from the cabinet on one side to the cabinet on the other side. Accordingly, since a cooling device is not needed in each cabinet, a reduction in the internal volume of the main body or an increase in the manufacturing cost may be prevented. Furthermore, by pulling the cabinet on one side to the cabinet on the other side by the above-described connection mechanism, the seal member interposed between the cabinet and the duct member is compressed, thereby ensuring the sealing property between the cabinet and the duct member.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Hereinafter, an embodiment of a refrigerator according to the disclosure will be described.

Figure 1:
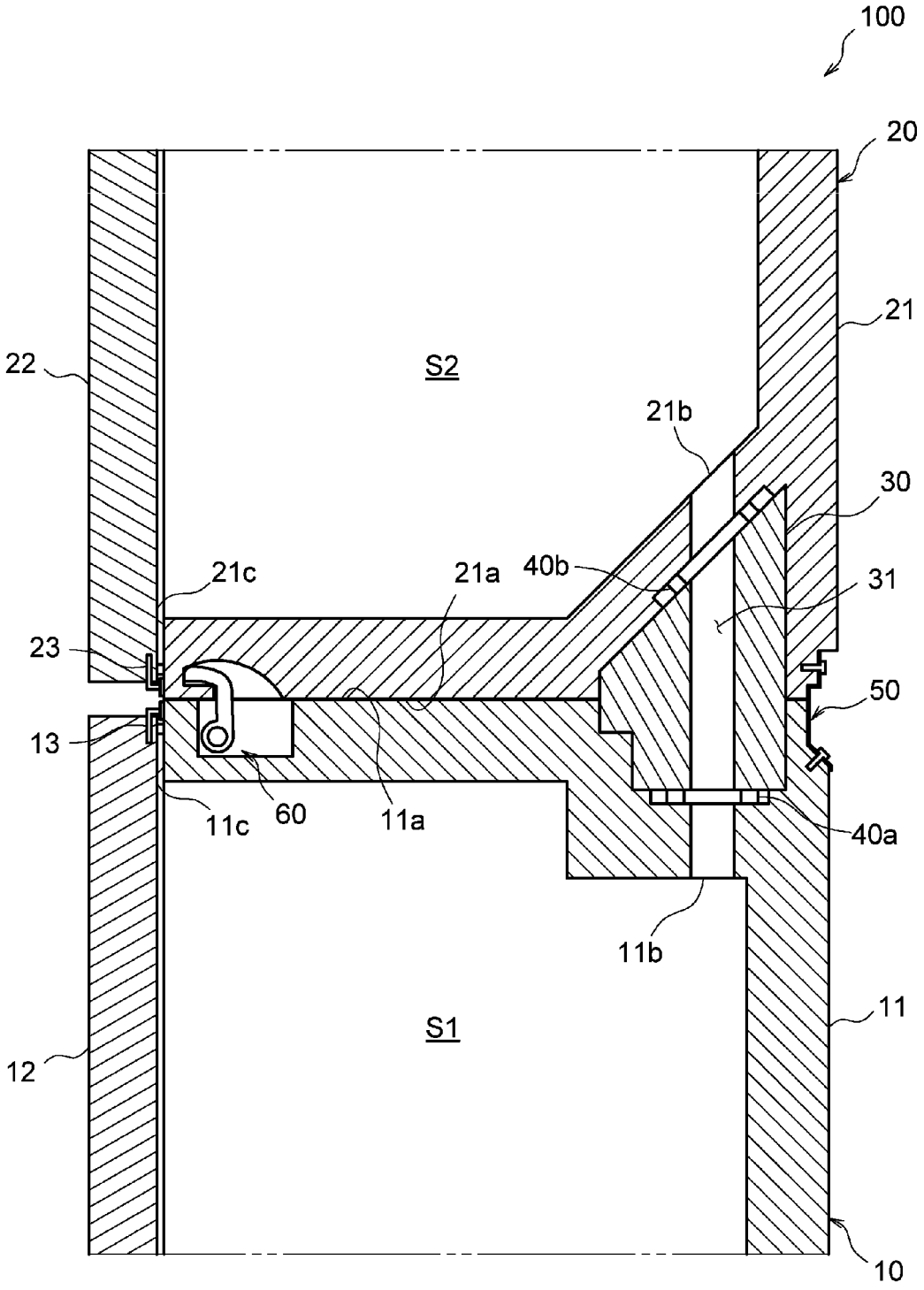
FIG. 1 is a schematic diagram illustrating a connected state of a refrigerator according to an embodiment of the disclosure.

FIG. 1 is a schematic diagram illustrating a connected state of a refrigerator according to an embodiment of the disclosure.

Figure 2:
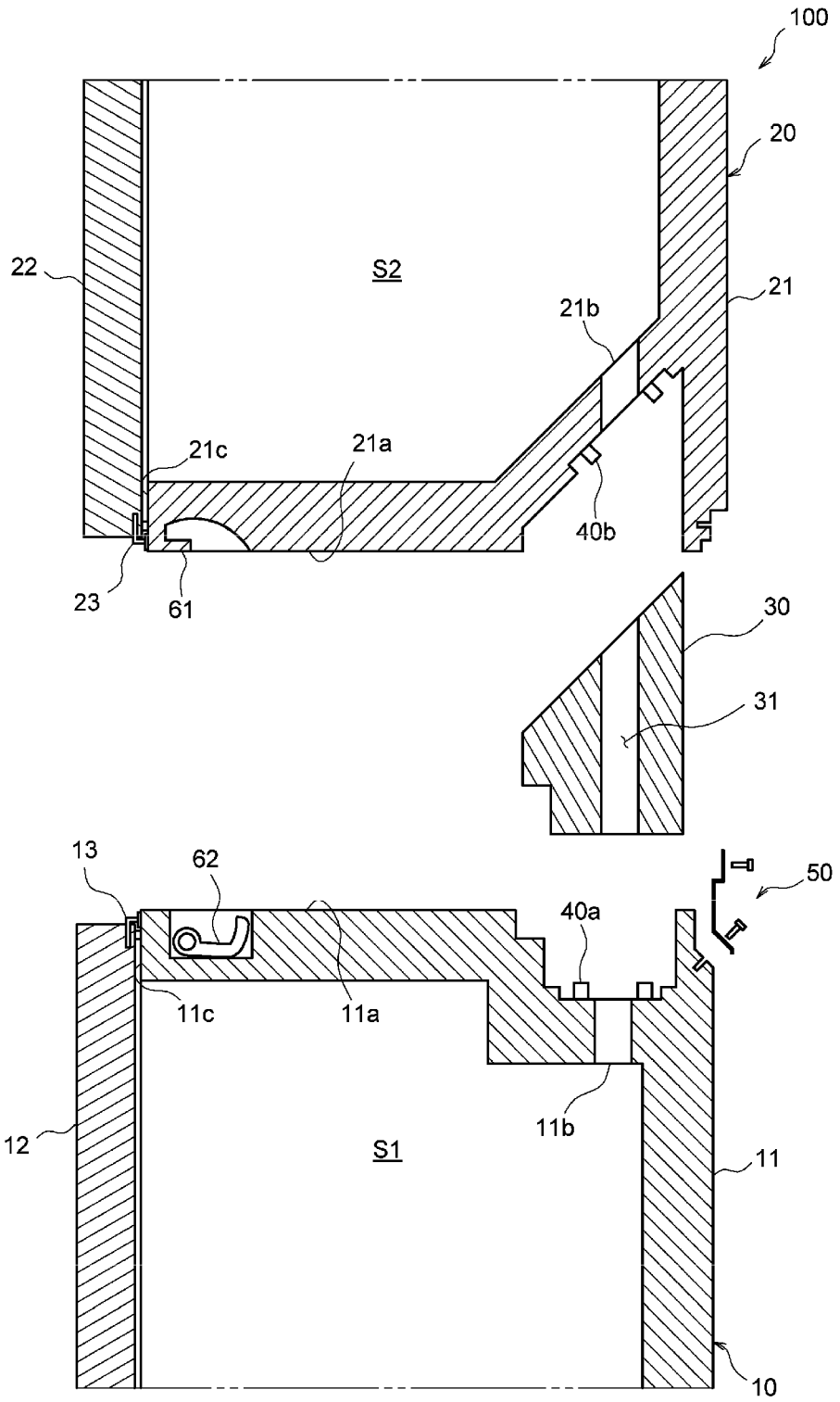
FIG. 2 is a schematic diagram illustrating an unconnected state of a refrigerator according to an embodiment of the disclosure.

FIG. 2 is a schematic diagram illustrating an unconnected state of the refrigerator according to an embodiment of the disclosure.

Referring to FIGS. 1 and 2, a refrigerator 100 according to an embodiment includes a first cabinet 10 and a second cabinet 20, which are detachably configured. The first cabinet 10 and the second cabinet 20 are installed to be adjacent to each other in an upper-lower direction. Here, although the second cabinet 20 is illustrated as being arranged on the first cabinet 10, the first cabinet 10 may be arranged on the second cabinet 20 or the first cabinet 10 and the second cabinet 20 may be arranged adjacent to each other in a left-right direction.

The first cabinet 10 is provided in a substantially rectangular parallelepiped shape, and has an inside that forms a cooling space 51 serving as a refrigerating chamber or a freezing chamber. Specifically, the first cabinet 10 includes a first cabinet body 11 that opens in a forward direction, and an opening/closing door 12 that closes the opening of the first cabinet body 11, and the first cabinet 10 is further provided with a cooling device (not shown) for cooling the cooling space 51.

The opening/closing door 12 is mounted to the first cabinet body 11 through a hinge member 13 so as to open and close the opening, and in a closed state, faces a front-end surface 11*c* of the first cabinet body 11.

The second cabinet 20 is provided in a substantially rectangular parallelepiped shape, and has an inside that forms a cooling space S2 serving as a refrigerating chamber or a freezing chamber. Specifically, the second cabinet 20 includes a second cabinet body 21 that opens in a forward direction, and an opening/closing door 22 that closes the opening of the second cabinet body 21.

The opening/closing door 22 is mounted to the second cabinet body 21 through a hinge member 23 so as to open and close the opening, and in a closed state, faces a front-end surface 21*c* of the second cabinet body 21.

In the embodiment, the second cabinet 20 does not include a cooling device, and cold air is allowed to pass between the cooling space S1 of the first cabinet 10 and the cooling space S2 of the second cabinet 20.

More specifically, the first cabinet body 11 has a first communication hole 11*b* that communicates the cooling space S1 with the outside, and the second cabinet body 21 has a second communication hole 21*b* that communicates the cooling space S2 with the outside, and the first communication hole 11*b* and the second communication hole 21*b* are provided to communicate with each other.

Here, an upper surface of the first cabinet body 11 and a lower surface of the second cabinet body 21 face each other, and the first communication hole 11*b* has one end opened at the upper surface of the first cabinet body 11 and the other end opened at the inner surface of the first cabinet body 11, while the second communication hole 21*b* has one end opened at the lower surface of the second cabinet body 21, and the other end opened at the inner surface of the second cabinet body 21.

In such a configuration, the refrigerator 100 according to the embodiment further includes a duct member 30 for communicating the first communication hole 11*b* with the second communication hole 21*b*. The duct member 30 is interposed between the first and second cabinets 10 and 20 on both sides, and the duct member 30 is provided with a through hole 31 including an opening at one end communicating with the first communication hole 11*b* and an opening at the other end communicating with the second communication hole 21*b*. Accordingly, the first communication hole 11*b*, the through hole 31, and the second communication hole 21*b* sequentially communicate with each other, thereby forming a flow path through which cold air flows between the cooling spaces S1 and S2 of the first and second cabinets 10 and 20 on both sides.

A seal member 40*a* is interposed between the duct member 30 and the first cabinet 10 to form an airtight state therebetween. Moreover, a seal member 40*b* is interposed between the duct member 30 and the second cabinet 20 to form an airtight state therebetween.

The first cabinet 10 and the second cabinet 20 are fastened at respective rear sides by a rear side connection mechanism 50.

Figure 3:
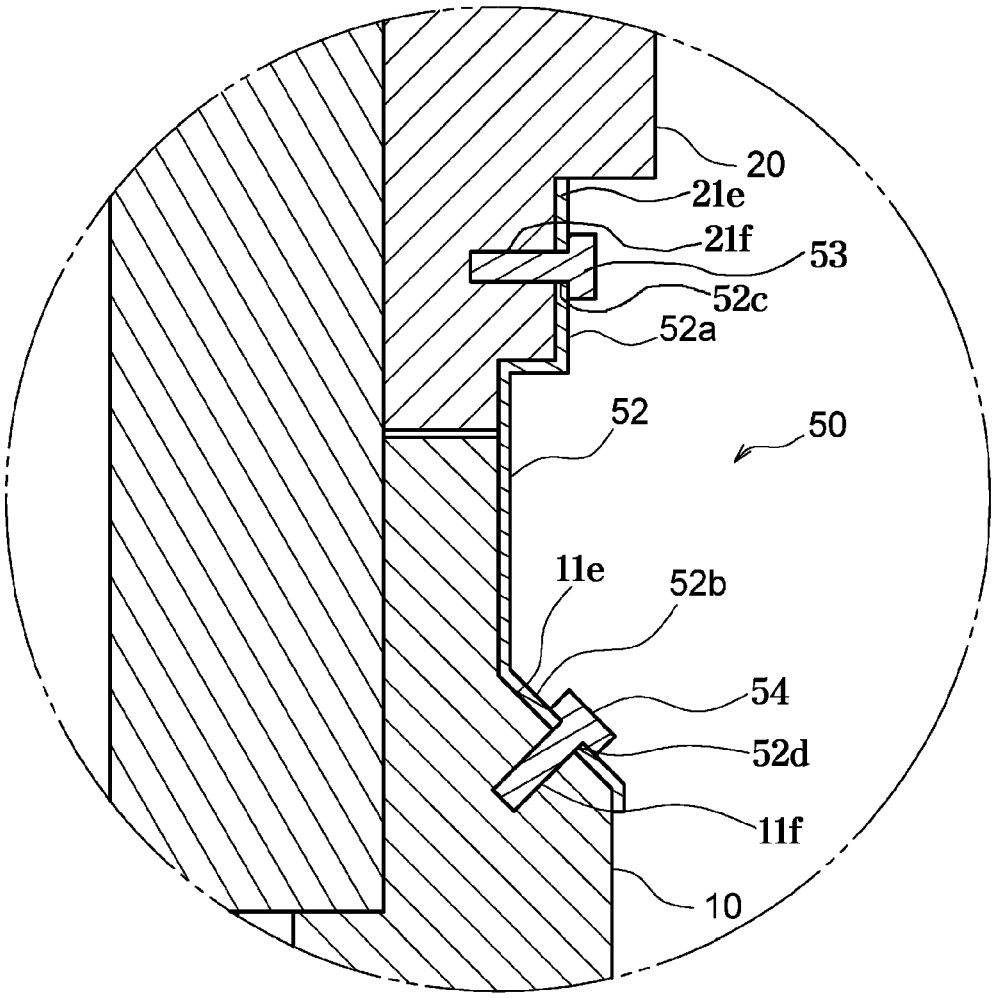
FIG. 3 is an enlarged schematic view illustrating a rear side connection mechanism of a refrigerator according to an embodiment of the disclosure.

FIG. 3 is an enlarged schematic view illustrating a rear side connection mechanism of a refrigerator according to an embodiment of the disclosure.

Referring to FIG. 3, a rear side connection mechanism 50 includes a connection plate 52 formed to extend between a connection surface 11*e* provided on a first cabinet 10 and a connection surface 21*e* of a second cabinet 20 and fastening members 53 and 54 for fastening the connection plate 52 to the connection surface 11*e* and the connection surface 21*e*.

The connection surface 11*e* is formed by a portion of a rear surface of the first cabinet 10 and faces a side in which the second cabinet 20 is placed. The connection surface 11*e* according to the embodiment is formed by cutting a corner formed by the upper surface and the rear surface of the first cabinet body 11, and is inclined downward along a direction from the front side to the rear side. Specifically, the connection surface 11*e* is inclined at 30 degrees or more and 60 degrees or less with respect to the horizontal plane.

The connection surface 21*e* may be formed by a portion of the rear surface of the second cabinet 20.

The connection plate 52 is formed by bending a long rod-shaped plate. Specifically, the connection plate 52 includes a fixed portion 52*a* fixed to the connection surface 21*e* of the second cabinet 20 and an opposing portion 52*b* facing the connection surface 11*e* of the first cabinet 10.

The connection surface 21*e* is formed with a screw hole 21*f*, and the fixed portion 52*a* of the connection plate 52 is formed with a screw through hole 52*c*. The fastening member 54 may be screwed to the screw hole 21*f* by passing through the screw through hole 52*c*.

The connection surface 11*e* may be formed with a screw hole 11*f*, and the opposing portion 52*b* of the connection plate 52 may be formed with a screw through hole 52*d*. The fastening member 53 may be screwed to the screw hole 11*f* by passing through the screw through hole 52*d*.

When the rear sides of the first and second cabinets 10 and 20 are connected by the rear side connection mechanism 50, the elasticity of the seal members 40*a* and 40*b* interposed between the first and second cabinets 10 and 20 may cause a front side of the second cabinet 20 to be lifted from the first cabinet 10.

Accordingly, the refrigerator 100 according to the embodiment further includes a front side connection mechanism 60 for connecting the front sides of the first and second cabinets 10 and 20, and a manipulation portion 70 for driving the front side connection mechanism 60. Hereinafter, a state in which the first and second cabinets 10 and 20 are connected to each other with the rear side and front side connection mechanisms 50 and 60 (a state shown in FIG. 5B) is referred to as a connected state, and a state in which the first and second cabinets 10 and 20 are not connected by any of the rear side and front side connection mechanisms 50 and 60 is referred to an unconnected state.

Figure 4:
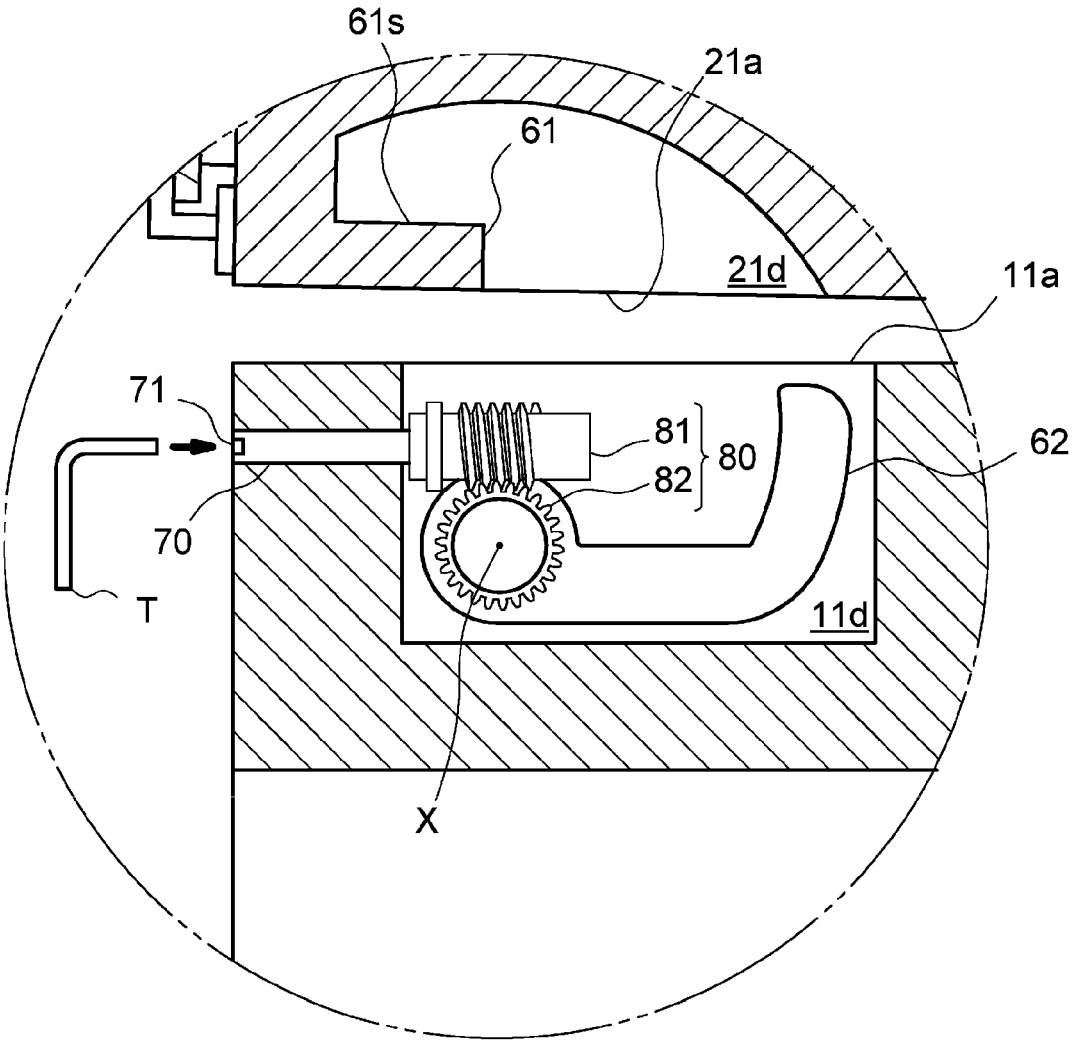
FIG. 4 is an enlarged schematic view of a front side connection mechanism of a refrigerator according to an embodiment of the disclosure.

FIG. 4 is an enlarged schematic view of a front side connection mechanism of a refrigerator according to an embodiment of the disclosure.

Referring to FIG. 4, a front side connection mechanism 60 is interposed between an opposing surface (hereinafter referred to as a first opposing surface 11*a*) of a first cabinet 10 opposite to a second cabinet 20, and an opposing surface (hereinafter referred to as a second opposing surface 21*a*) of the second cabinet 20 opposite to the first cabinet 10, and is configured to allow the second cabinet 20 to be pulled toward and connected to the first cabinet 10.

Specifically, the front side connection mechanism 60 may include a catching portion 62 engaged with a caught portion 61 provided on the second opposing surface 21*a*. The front side connection mechanism 60 may be provided on the first opposing surface 11*a*.

The caught portion 61 is provided on an inner side of the second opposing surface 21*a*, and has a caught surface 61*s* facing a side (an upper side) opposed to the second opposing surface 21*a*. Specifically, the caught surface 61*s* is provided in a recessed portion 21*d* formed by recessing a portion of the second opposing surface 21*a*. The caught portion 61 according to the embodiment is, for example, in the shape of a long rod, such as a rod shape or a plate shape, which is suspended in the recessed portion 21*d*. Accordingly, the caught surface 61*s* also forms a long bar shape, and extends in the left-right direction (a direction perpendicular to the paper in FIG. 4) in the recessed portion 21*d*.

The catching portion 62 is accommodated on an inner side of the first opposing surface 11*a* in an unconnected state as shown in FIG. 4. Specifically, the catching portion 62 is accommodated in an accommodating portion 11*d* formed by recessing a portion of the first opposing surface 11*a*, and in an unconnected state, is entirely accommodated in the accommodating portion 11*d* without protruding from the first opposing surface 11*a*.

Figure 5A:
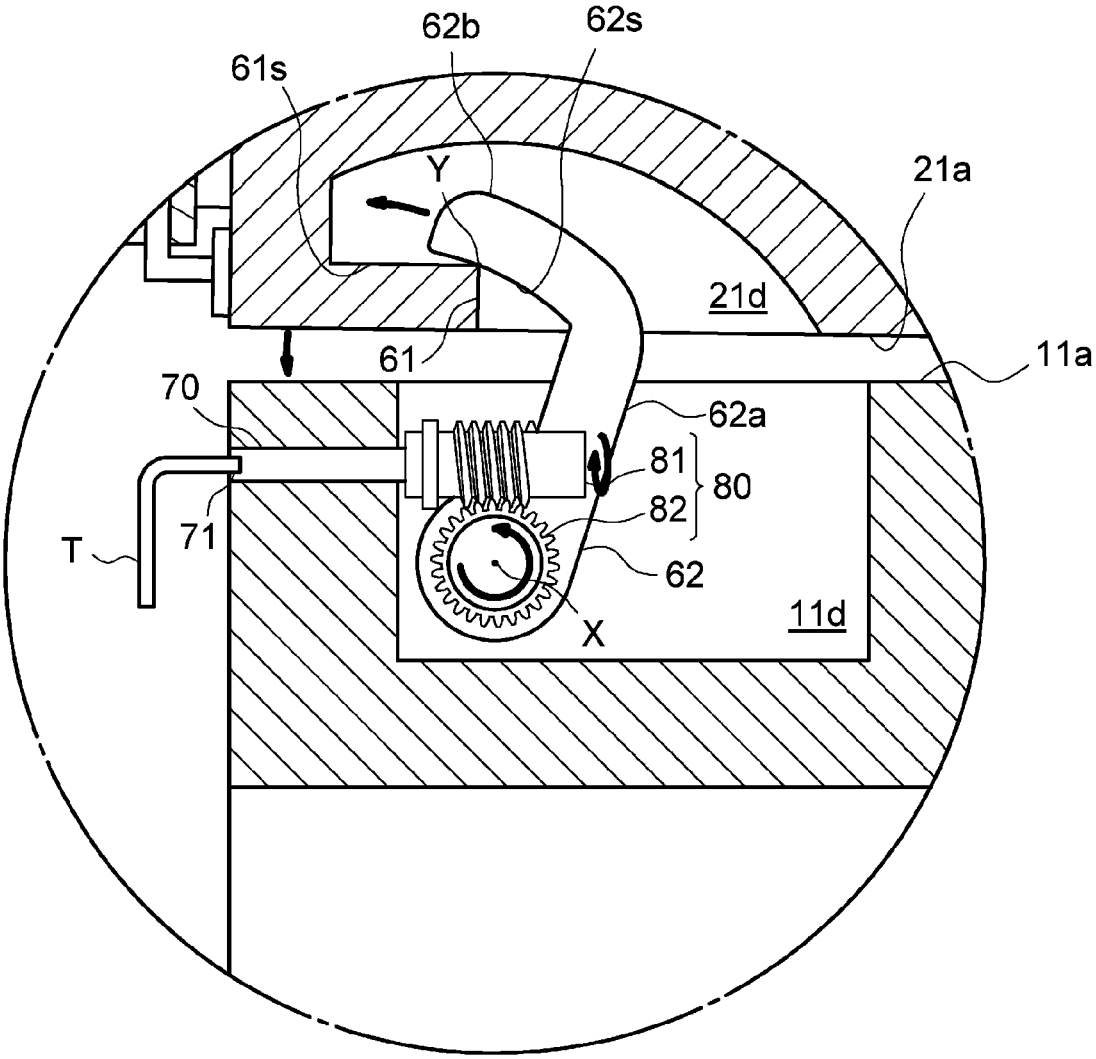
FIGS. 5A and 5B are enlarged schematic views illustrating a front side connection mechanism of a refrigerator according to various embodiments of the disclosure.
Figure 5B:
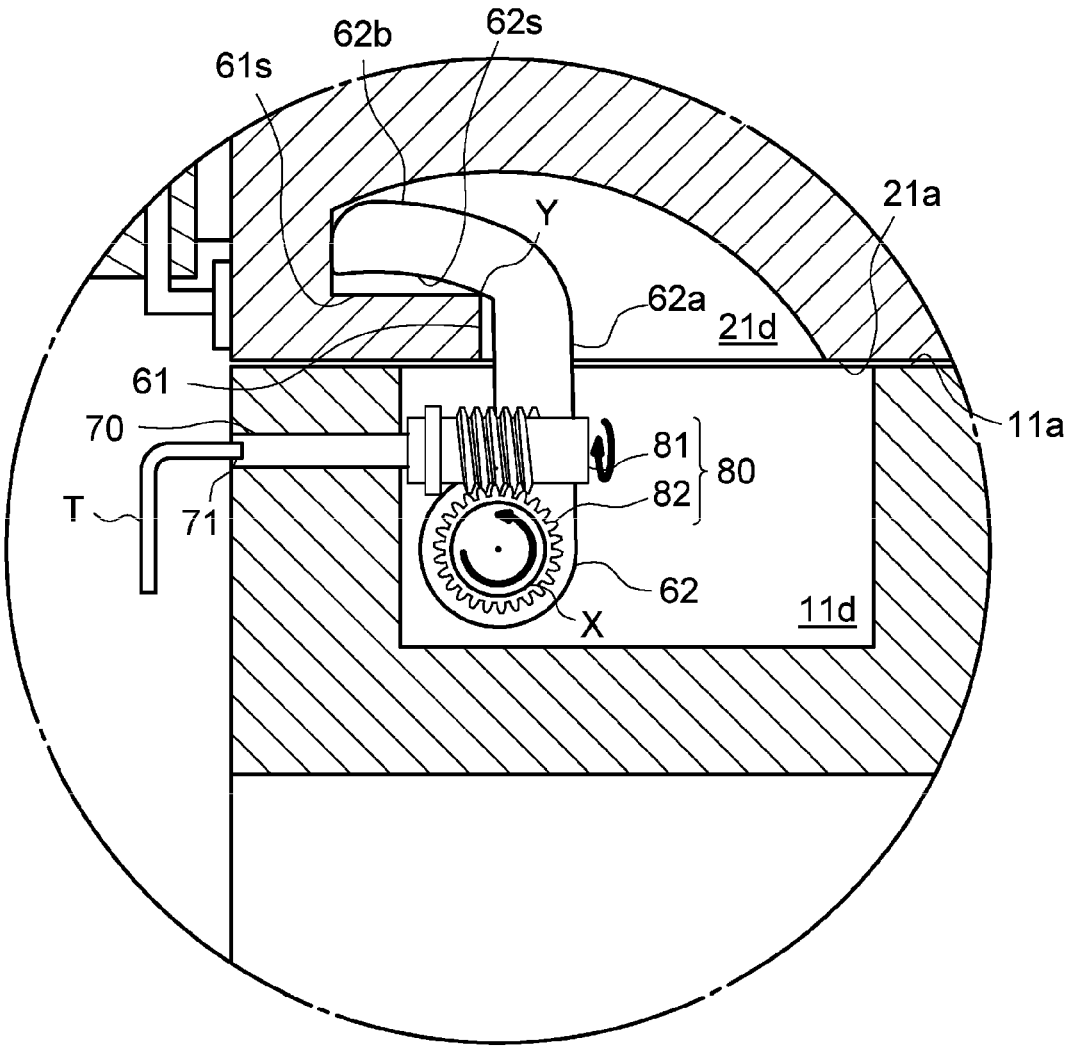

FIGS. 5A and 5B are enlarged schematic views illustrating a front side connection mechanism of a refrigerator according to various embodiments of the disclosure.

Referring to FIG. 5B, a catching portion 62 includes an extension portion 62*a* extending from a side of the first cabinet 10 to a side of the second cabinet 20 in a connected state, and a front-end portion 62*b* bent from a front-end (a tip) of the extension portion 62*a* toward a caught portion 61. Accordingly, the catching portion 62 is provided to allow the front-end portion 62*b* to be engaged with the caught portion 61.

In addition, the catching portion 62 is rotatable about a rotation shaft 'X' provided in the accommodating portion 11*d*, and is engaged with the caught portion 61 by the rotation operation. Specifically, the catching portion 62 is subject to a change in states between an accommodated state in which the catching portion 62 is accommodated lying in the accommodating portion 11*d* as shown in FIG. 4, a catching start state in which the catching portion 62 in the accommodated state rotates about the rotation shaft X to erect such that the front-end portion 62*b* starts to be engaged with the caught portion 61 as shown in FIG. 5A, and a connected state in which the catching portion 62 in the catching start state further rotates about the rotation shaft X to be engaged with the caught portion 61 while pulling the second cabinet 20 toward the first cabinet 10 to connect the second cabinet 20 to the first cabinet 10 as shown in FIG. 5B.

In the embodiment, the catching portion 62 is axially supported on the rotation shaft X on which the extension portion 62*a* extends in the left-right direction, and operates such that the front-end portion 62*b* rotates back and forth. In addition, the catching portion 62 is engaged with the caught portion 61 by approaching the caught portion 61 from the rear side.

The width of the front-end portion 62*b* is smaller than the width of the recessed portion 21*d*, and is smaller than the width of the caught portion 61. In this case, the width refers to a dimension in the direction of the rotation shaft X.

A surface of the front-end portion 62*b* that faces the inner side thereof forms a catching surface 62*s* configured to be engaged with the caught surface 61*s*. In addition, the distance from the rotating shaft X to the catching surface 62*s* is provided to gradually increase as being directed toward the front-end.

In the catching start state of the catching portion 62, as shown in FIG. 5A, a distal end side of the catching surface 62*s* comes in contact with the caught surface 61*s* and is engaged with the caught portion 61. In the connected state of the catching portion 62, as shown in FIG. 5B, a basal end side of the catching surface 62*s* comes in contact with the caught surface 61*s* such that the catching portion 62 is engaged with the caught portion 61. That is, while the catching portion 62 changes from the catching start state to the connected state, a catching position 'Y' (a contact position) of the catching surface 62*s* with respect to the caught surface 61*s* shifts from the distal end side to the basal end side.

Figure 6:
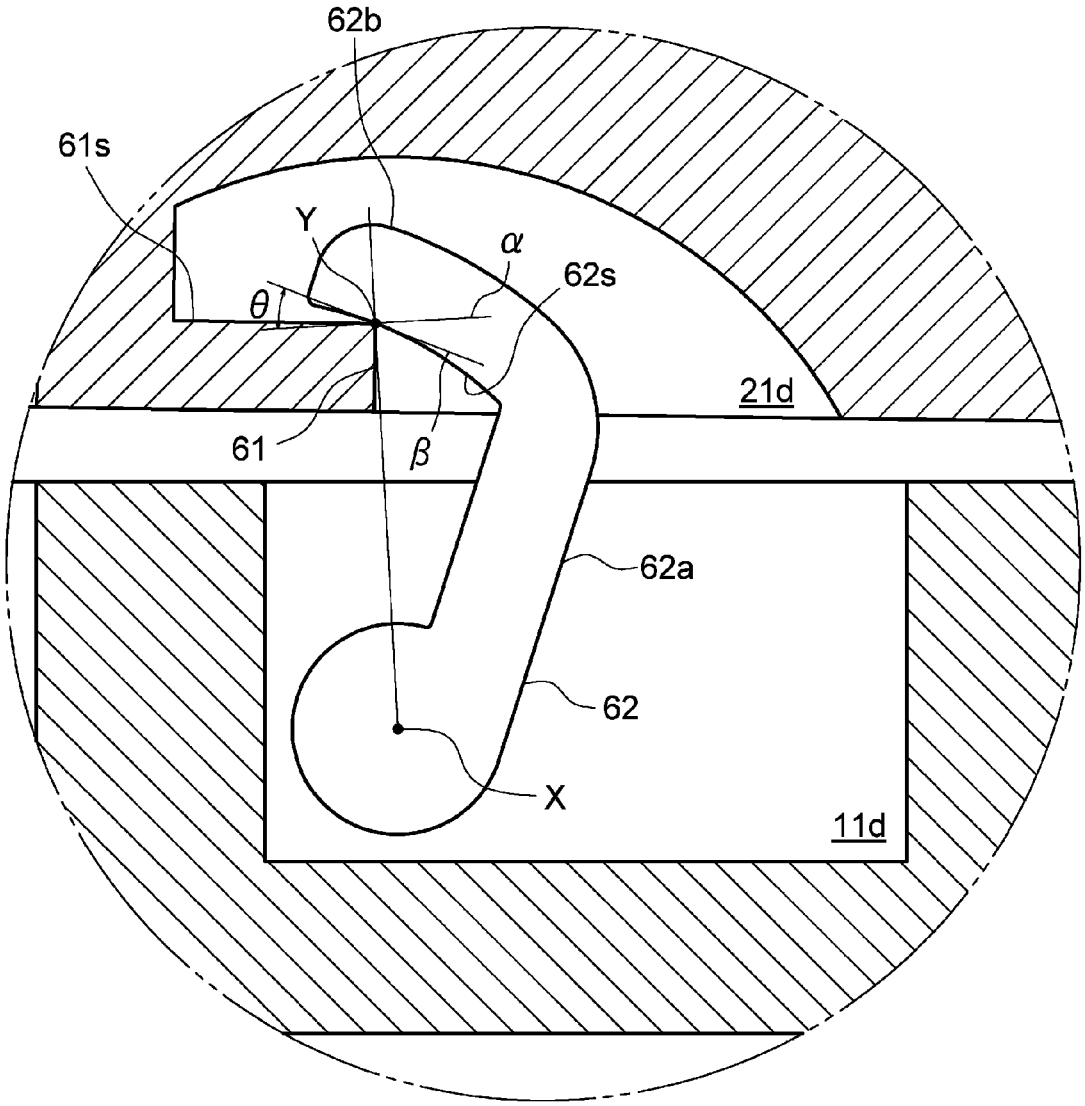
FIG. 6 is an enlarged schematic view illustrating a front side connection mechanism of a refrigerator according to an embodiment of the disclosure.

FIG. 6 is an enlarged schematic view illustrating a front side connection mechanism of a refrigerator according to an embodiment of the disclosure.

Referring to FIG. 6, an angle (an intersection angle) θ formed by an imaginary surface α perpendicular to a plane including the rotation shaft X and the catching position Y and a tangent plane β of the catching surface 62*s* passing through the catching position Y is maintained at an acute angle until the catching portion 62 in a catching start state reaches a connected state. More specifically, the angle θ is maintained at 45 degrees or less, more specifically, at 10 degrees or more and 30 degrees or less, until the catching portion 62 in a catching start state reaches a connected state.

The manipulation portion 70 is manipulated from the outside to drive the front side connection mechanism 60, and is mechanically connected to the front side connection mechanism 60 through a power transmission mechanism 80. Specifically, the manipulation portion 70 is configured to receive power input from one end thereof and transmits the power to the catching portion 62 through the power transmission mechanism 80 connected to the other end thereof such that the transmitted power drives the catching portion 62. The manipulation portion 70 is provided to receive a driving force for the front side connection mechanism 60 from the outside, and provided, for example, as a shaft mechanism including a tool hole 71 to which a tool 'T', such as a hexagon wrench or a screwdriver, is connected. In addition, the manipulation portion 70 is provided to be rotatable by a tool connected to the tool hole 71. Here, the specific form of the manipulation portion 70 is not limited to the shaft mechanism, and may be provided in various forms, for example, as a gear, a link, or a combination thereof, etc., as long as it can transmit power from the outside to the front side connection mechanism 60 through the power transmission mechanism 80.

One end surface of the manipulation portion 70 (a portion manipulated from the outside, that is, a portion to which power is input from the outside) is provided on the front-end surface 11*c* of the first cabinet 10. In the embodiment, the one end surface of the manipulation portion 70 is arranged to be covered and hidden by the hinge member 13 for the opening/closing door mounted on the front-end surface 11*c*.

The power transmission mechanism 80 is interposed between the manipulation portion 70 and the catching portion 62 and transmits the power input to the manipulation portion 70 to the catching portion 62. The power transmission mechanism 80 is composed of, for example, a worm gear. Specifically, the power transmission mechanism 80 includes a worm 81 connected to the other end of the shaft mechanism constituting the manipulation portion 70 and rotating together with the shaft mechanism, and a worm wheel 82 meshing with the worm 81. The worm wheel 82 is axially supported by the rotation shaft X of the catching portion 62.

Next, a method of assembling the refrigerator 100 according to the embodiment will be described.

In the refrigerator 100 according to the embodiment, the first and second cabinets 10 and 20 on the both sides are roughly aligned in the vertical direction, are connected by the rear side connection mechanism, and then connected by the front side connection mechanism.

In more detail, first, the duct member 30 is installed on the first cabinet 10. Next, the second cabinet 20 is loaded on the first cabinet 10. In this case, since both the catching portion 62 and the caught portion 61 are accommodated on the inner sides of the first and second opposing surfaces 11*a* and 21*a*, the first and second cabinets 10 and 20 may be aligned while matching the first and second opposing surfaces 11*a* and 21*a* with each other.

Next, the rear sides of the first and second cabinets 10 and 20 are connected to each other using the rear side connection mechanism 50. Specifically, the connection plate 52 is installed on the back sides of the first and second cabinets 10 and 20. Then, the connection plate 52 is fixed to the connection surface 21*e* of the second cabinet 20, and the opposing portion 52*b* is arranged to be opposed to the connection surface 11*e* of the first cabinet 10. Then, the connection plate 52 is fastened to the connection surface 11*e* with the fastening member 54. Accordingly, the rear side of the second cabinet 20 is brought into close contact with the rear side of the first cabinet 10 by the fastening member 54, and the seal members 40*a* and 40*b* are compressed. In addition, the front side of the second cabinet 20 is lifted and separated from the first cabinet 10 by the sealing members 40*a* and 40*b*. In this case, the catching portion constituting the front side connection mechanism 60 is in an accommodated state.

Next, the front sides of the first and second cabinets 10 and 20 spaced apart from each other are connected to each other through the front side connection mechanism 60. Specifically, a tool is connected to the tool hole 71 to rotate the manipulation portion 70. Accordingly, the rotation of the manipulation portion 70 is transmitted to the catching portion 62 in an accommodated state through the power transmission mechanism 80, and the transmitted power causes the catching portion 62 in the accommodated state to be rotated and erected. By further rotating the manipulation portion 70, the power is transmitted to the catching portion 62 through the power transmission mechanism 80, so that the catching portion 62 rotates from the accommodated state to the catching start state to thereby be engaged with the caught portion 61. Thereafter, by further rotating the manipulation portion 70, the power is transmitted to the catching portion 62 through the power transmission mechanism 80, so that the catching portion 62 in the catching start state further rotates to thereby be engaged with the caught portion 61 while allowing the second cabinet 20 to be pulled toward and connected to the first cabinet 10, setting into a connected state.

As described above, when the first and second cabinets 10 and 20 on the both sides are connected by the rear side and front side connection mechanisms 50 and 60, the first and second opposing surfaces 11*a* and 21*a* of the first and second cabinets 10 and 20 come in close contact with each other, and at the same time, the sealing members 40*a* and 40*b* are compressed uniformly as a whole such that the sealing performance between each of the first and second cabinets 10 and 20 and the duct member 30 is ensured.

With such a configuration, since the front side connection mechanism is interposed between the cabinets adjacent to each other, an aesthetic appearance of the refrigerator is secured. Furthermore, since the front side connection mechanism is driven by a manipulation of the manipulation portion to pull and connect the second cabinet to the first cabinet, the operator may simply connect cabinets on both sides. Further, since the worm gear is used as the power transmission mechanism, the rotation of the catching portion is locked in a state in which the manipulation portion is not manipulated. Accordingly, when an external force is applied to the both side cabinets in a connected state, the catching portion is prevented from being separated from the caught portion. In addition, since the rear surfaces of the cabinets on both sides, which do not affect impairment of the exterior of the refrigerator, are connected by the rear side connection mechanism that may be screwed from the outside, the rear sides of the cabinets on the both sides may be simply connected.

OTHER EMBODIMENTS

In the above embodiment, the catching portion is provided on the inner side of the first opposing surface in the unconnected state, but in this state, the catching portion may be provided to protrude from the first opposing surface.

In the above embodiment, the caught portion is provided on the inner side of the second opposing surface in the unconnected state, but in this state, the caught portion may be provided to protrude from the second opposing surface.

The catching portion may not rotate about the rotation axis provided on the first opposing surface. For example, the catching portion may move in a direction perpendicular to or parallel to the first opposing surface.

The front side connection mechanism may include, for example, screw holes provided in portions corresponding to the cabinets on both sides, and a screw member screwed to the screw holes.

The cabinets on both sides may be configured to allow the communicating holes to directly communicate with each other without interposing a duct member. In this case, only the seal member may be interposed between the cabinets on both sides.

The manipulation portion may be configured to, for example, drive a driving mechanism, such as a drive motor connected to the connection mechanism such that the connection mechanism is driven by the driving force. In this case, the manipulation portion may include a power button or the like for supplying electric power to the drive mechanism.

In the above embodiment, a worm gear is used as the power transmission mechanism, but a helical gear may be used. In this case, since the helical gear does not serve to lock the rotation of the catching portion, it is preferable to further include a locking device for locking rotation of the manipulation portion. The locking device may be provided using a pin protruding from a portion facing a tool hole of the hinge member. The pin has the same cross-sectional shape as that of a tool inserted into the tool hole. Accordingly, in a case the hinge member is mounted on the first cabinet, when the pin is inserted into the tool hole, the rotation of the manipulation portion is regulated, so that the rotation of the catching portion is locked.

As is apparent from the above, the refrigerator in which adjacent cabinets are detachably provided can ensure the esthetically pleasing appearance and allow both side cabinets to be easily connected to each other.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A refrigerator comprising:

a first cabinet comprising a first cooling space;

a second cabinet comprising a second cooling space independent of the first cooling space, the second cabinet being detachably coupled to the first cabinet;

a connection mechanism provided on a first opposing surface of the first cabinet opposite to the second cabinet to allow the second cabinet to be pulled toward the first cabinet and connected to the first cabinet, the connection mechanism including a catching portion rotatable on a rotation shaft; and a manipulation portion connected to the connection mechanism to drive the connection mechanism, the manipulation portion being provided on the first cabinet to be manipulated from an outside of the first cabinet, wherein the second cabinet includes a front-end surface facing a front of the refrigerator and a caught portion extending in rearward from the front-end surface, the caught portion including a caught surface facing upward and provided to be engaged with the catching portion.

2. The refrigerator of claim 1, wherein the caught portion is provided on a second opposing surface of the second cabinet being opposite to the first opposing surface of the first cabinet.

3. The refrigerator of claim 2, wherein the catching portion comprises:

an extension portion extending from the first cabinet to the second cabinet in a connected state in which the first cabinet and the second cabinet are connected to each other; and a front-end portion bent from a front-end of the extension portion toward the caught portion to engage with the caught portion.

4. The refrigerator of claim 1, wherein the connection mechanism is configured to rotate between an accommodated state and a connected state, the connection mechanism in the accommodated state being accommodated on an inner side of the first opposing surface of the first cabinet, the connection mechanism in the connected state being engaged with the caught portion of the second cabinet by allowing the second cabinet to be pulled toward the first cabinet and connected to the first cabinet.

5. The refrigerator of claim 4, wherein the first opposing surface of the first cabinet is formed with an accommodating portion, and wherein, based on the connection mechanism being in the accommodated state, the connection mechanism is accommodated in the accommodating portion without protruding from the accommodating portion.

6. The refrigerator of claim 2, wherein the caught portion is formed on an inner side of the second opposing surface of the second cabinet without protruding out of the second cabinet.

7. The refrigerator of claim 4, wherein a second opposing surface of the second cabinet is formed with a recessed portion, and wherein, based on the connection mechanism being in the connected state, a part of the connection mechanism is inserted into the recessed portion.

8. The refrigerator of claim 1, wherein the manipulation portion comprises a tool hole to which a tool is connected, and wherein the manipulation portion is rotatable by the tool connected to the tool hole.

9. The refrigerator of claim 8, wherein the manipulation portion further comprises at least a portion provided on a front-end surface of the first cabinet to be manipulated from the outside of the first cabinet.

10. The refrigerator of claim 9, further comprising:

a door disposed in front of the first cabinet, the door being configured to open and close the first cooling space; and a hinge member configured to rotatably couple the door to the first cabinet, wherein the at least a portion of the manipulation portion is covered by the hinge member without being exposed to the outside of the first cabinet.

11. The refrigerator of claim 1, further comprising a power transmission mechanism disposed between the manipulation portion and the connection mechanism, the power transmission mechanism being configured to transmit an external force input to the manipulation portion to the connection mechanism.

12. The refrigerator of claim 11, wherein the power transmission mechanism comprises:

a worm connected to the manipulation portion and configured to rotate together with the manipulation portion; and a worm wheel meshing with the worm and axially supported by the rotation shaft of the connection mechanism.

13. The refrigerator of claim 1, further comprising a duct member provided between the first cabinet and the second cabinet to communicate the first cooling space with the second cooling space.

14. The refrigerator of claim 13, wherein each of the first cabinet and the second cabinet further comprises a communication hole that allows a corresponding one of the first cooling space and the second cooling space to communicate with the duct member, and wherein the refrigerator further comprises a seal member configured to seal the communication hole.

15. The refrigerator of claim 1, further comprising:

a rear side connection mechanism coupling a rear end of the first cabinet to a rear end of the second cabinet, wherein the rear side connection mechanism comprises:

a connection plate arranged on a rear surface of the first cabinet and a rear surface of the second cabinet, and a fastening member configured to fasten the connection plate to the rear surface of the first cabinet and the rear surface of the second cabinet.

16. The refrigerator of claim 1, wherein the manipulation portion comprises a shaft mechanism including a tool hole to which a tool is connectable, and wherein the shaft mechanism is configured to transmit power from the outside of the first cabinet to the connection mechanism through a power transmission mechanism.

17. The refrigerator of claim 16, wherein the tool comprises at least one of a hexagon wrench or a screwdriver.

18. The refrigerator of claim 1, wherein, based on the connection mechanism being in an accommodated state of being accommodated on an inner surface of the first cabinet, the manipulation portion and the connection mechanism extend in a first direction, and wherein, based on the connection mechanism being in a connected state of being engaged with the caught portion of the second cabinet thereby pulling the first cabinet closer to the second cabinet, the manipulation portion extends in a second direction perpendicular to the first direction.

* * * * *